US007040726B2

(12) United States Patent
Steffee

(10) Patent No.: US 7,040,726 B2
(45) Date of Patent: May 9, 2006

(54) PULL FOR PULLING OPEN A CABINET DOOR OR A DRAWER

(76) Inventor: Arthur Steffee, P.O. Box 349, Foxburg, PA (US) 16036

( * ) Notice: Subject to any disclaimer, the term of this patent is extended or adjusted under 35 U.S.C. 154(b) by 426 days.

(21) Appl. No.: 10/444,659

(22) Filed: May 23, 2003

(65) Prior Publication Data

US 2004/0232811 A1 Nov. 25, 2004

(51) Int. Cl.
*A47B 95/02* (2006.01)

(52) U.S. Cl. ..... 312/348.6; 312/330.1; 312/348.1; 312/348.4; 16/415

(58) Field of Classification Search ..... 312/348.6 OR, 312/330.1, 348.1, 348.2, 348.4; 16/415 X, 16/417, 441
See application file for complete search history.

(56) References Cited

U.S. PATENT DOCUMENTS 322,031 A * 7/1885 Wixon et al. ..... 312/330.1
420,062 A * 1/1890 Hart ..... 229/117.19
2,805,911 A 9/1957 Anderson
4,379,603 A 4/1983 Johnson et al.
5,501,171 A * 3/1996 Leake ..... 116/234

* cited by examiner

*Primary Examiner*—Laurie K. Cranmer
(74) *Attorney, Agent, or Firm*—Tarolli, Sundheim, Covell & Tummino L.L.P.

(57) ABSTRACT

A pull (12) includes an elongate flexible member (34) having two end portions. The first end portion (36) is secured to the rear surface (20, 106) of the front structure (16, 102) of a movable member (14, 100) of a piece of furniture made of wood. The flexible member (34) has an intermediate portion (39) extending from the first end portion (36). The intermediate portion (39) extends over an upper region of the front structure (16, 102) of the movable member (14, 100). The flexible member (34) has a manually gripable rigid part (40) at the second end portion (38). The manually gripable rigid part (40) lies against, without being secured to, the front surface (20, 106) of the front structure (16, 102) of the movable member (14, 100). The manually gripable rigid part (40) is pulled to open the movable member (14, 100).

8 Claims, 2 Drawing Sheets

PULL FOR PULLING OPEN A CABINET DOOR OR A DRAWER

Technical Field

The present invention relates to a decorative pull for mounting on a wood drawer or wood door for pulling open the drawer door.

BACKGROUND OF THE INVENTION

Some furniture pieces which have cabinet doors and drawers are made from expensive wood. The furniture may be aesthetically designed without hardware on the front face of the drawers or cabinet doors for pulling open the drawers and cabinet doors.

It is known that furniture with drawers may be shipped with temporary pulls formed of masking tape. These temporary pulls are formed by sticking a strip of masking tape to the inside of the drawer front. A portion of the masking tape extends outward from the drawer front and is folded back on itself to form a manually engagable projection.

Permanent furniture hardware is typically attached to the front face of a drawer or a door by fasteners or the like which extend into the surface of the wood. However, it may not be desirable to mar the wood material of a drawer or a door by attaching the hardware with screws or the like that penetrate the front face of the drawer or door. Thus, there is a need for a pull which provides a manually gripable portion for pulling open a drawer or a door made from wood and which is mounted in a manner that does not damage the wood.

SUMMARY OF THE INVENTION

The present invention relates to a pull for pulling open a movable member made of wood, which member closes an opening. The pull includes an elongate flexible member having first and second end portions. The first end portion is connectable to an inner wood surface of a front portion of the movable member. The flexible member has an intermediate portion disposed between the first and second end portions and extendable over an edge portion of the movable member. The flexible member has a manually gripable rigid part which is engagable with an outer front surface of the movable member. The manually gripable rigid part is spaced from the movable member and the intermediate portion is tensioned when pulling open the movable member to open the opening.

According to an embodiment of the invention, a pull is used to pull open a drawer. The drawer includes a drawer front structure having a front surface and a rear surface facing opposite the front surface. The front surface is spaced from the rear surface by a peripheral edge surface extending between and connecting the front surface and the rear surface. The pull includes an elongate flexible member having two end portions. The first end portion is secured to the rear surface of the drawer front structure. The flexible member has an intermediate portion which extends between the two end portions and extends over an upper portion of the drawer front structure. The flexible member has a manually gripable part at the second end portion. The manually gripable part lies against, without being secured to, the front surface of the drawer front structure. The manually gripable part is pulled to open the drawer.

According to one feature of the present invention, the manually gripable part is not attached to the front of the drawer and, when pulled to open the drawer, is moved out of engagement with the front of the drawer.

According to another feature of the present invention, the flexible member is made of a flexible material and the manually gripable part includes a rigid article encased by the flexible material or otherwise attached to the flexible material and a decorative element is attached to the flexible material.

According to yet another feature of the present invention, the flexible material can be velvet, velveteen, silk, satin, flannel, fleece, brocade, imitation leather, imitation suede, cotton fabric, polyester fabric, cotton/polyester blend fabric, or a strip of leather.

According to yet still another feature of the present invention, the decorative element can be a button, imitation jewelry, imitation wood or a wood carving.

According to still another feature of the present invention, the rigid article is made of wood, metal or plastic.

According to still another feature of the present invention, the flexible elongate member is made of a strip of leather and the manually gripable rigid part includes a rigid article encased by the strip of leather and a decorative element is attached to the strip of leather encasing the rigid article. The decorative element is visible when viewing the front face of the drawer.

According to another embodiment of the invention, a pull is used for pulling open a cabinet door made of wood, which door closes an opening. The pull includes an elongate flexible member having first and second end portions. The first end portion is connectable to an inner wood surface of a front portion of the cabinet door. The flexible member has an intermediate portion disposed between the first and second end portions and extendable over an edge portion of the cabinet door. The flexible member has a manually gripable rigid part which is engagable with an outer front surface of the cabinet door. The manually gripable rigid part is spaced from the cabinet door and the intermediate portion is tensioned when pulling open the cabinet door to open the opening.

The present invention has a plurality of different features. These features may advantageously be utilized in combination with each other in the manner disclosed herein. Alternatively, the various features of the invention may be utilized separately and/or in combination with features from the prior art.

BRIEF DESCRIPTION OF THE DRAWINGS

The foregoing and other features of the present invention will become apparent to those skilled in the art to which the present invention relates upon reading the following description with reference to the accompanying drawings, in which.

DESCRIPTION OF PREFERRED EMBODIMENTS

Figure 1:
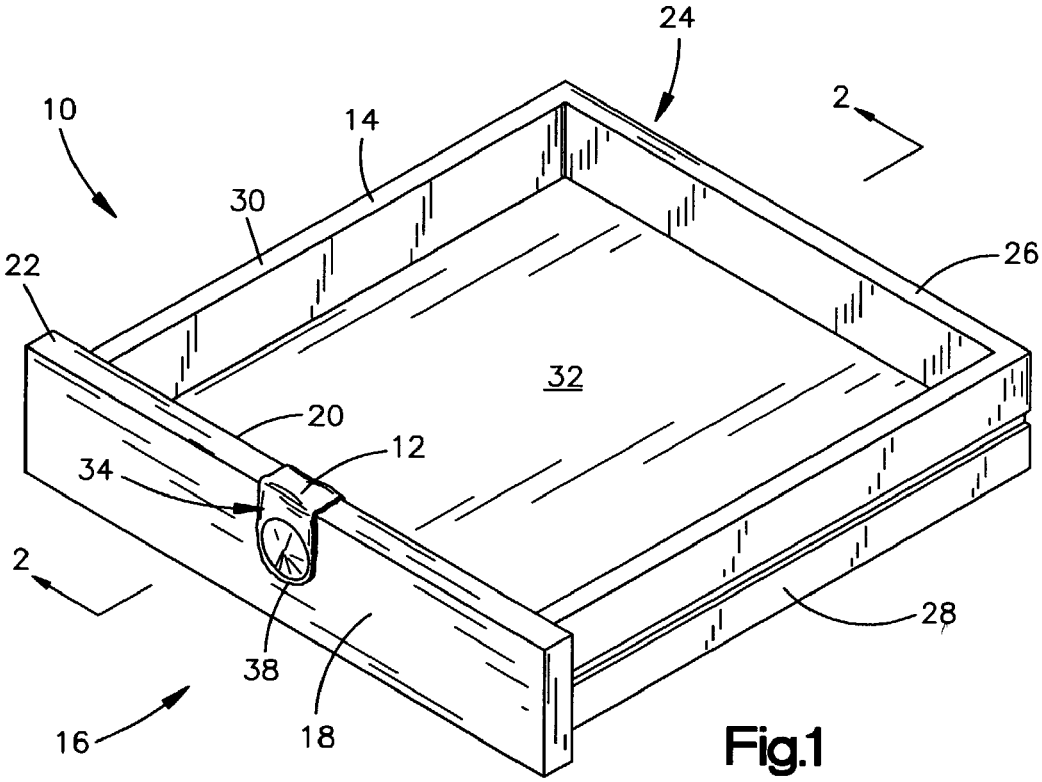
FIG. 1 is a schematic perspective view of a drawer with a pull constructed in accordance with the present invention.

As representative of the present invention, FIG. 1 illustrates an assembly 10 including a pull 12 mounted on a drawer 14. The drawer 14 may be part of a piece of furniture (not shown) such as a desk or a dresser. The drawer 14 is made of any suitable material including an expensive type of wood such as rose wood, black walnut, black cherry or the like.

The drawer 14 has a drawer front structure 16. The drawer front structure 16 has a front surface 18 and a rear surface 20 facing in a direction opposite the front surface 18. The front surface 18 is spaced apart from the rear surface 20 by a peripheral edge surface 22 extending between and connecting the front surface 18 and the rear surface 20.

The drawer 14 also has a container portion 24 for containing articles (not shown) placed into the drawer. The container portion 24 is defined by the front structure 16, a back wall 26 spaced apart from and extending parallel to the front structure 16, and two parallel side walls 28 and 30 extending perpendicular to the back wall and front structure and connecting the back wall and front structure to each other. The container portion 24 also has a bottom wall 32 extending from the front structure 16 to the back wall 26.

Figure 2:
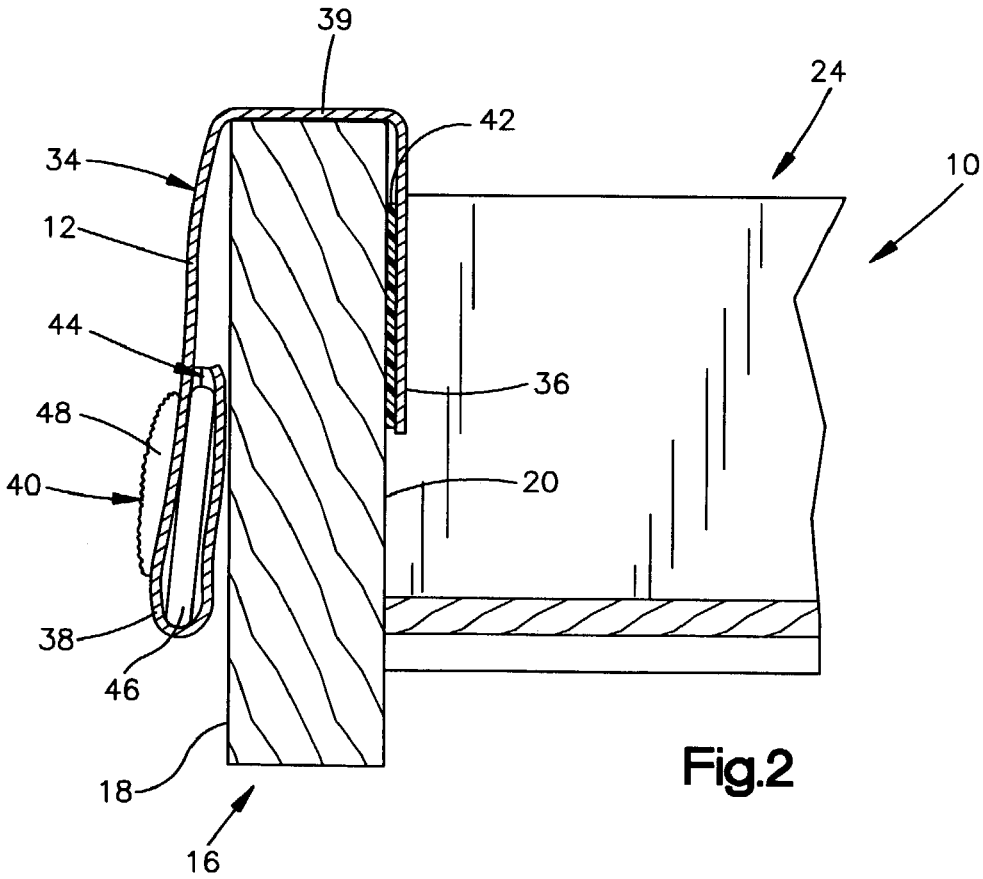
FIG. 2 is a sectional view taken along line 2—2 in FIG. 1.

As best illustrated in FIG. 2, the pull 12 is attached to the drawer 14 and is for pulling open the drawer. The pull 12 includes an elongate flexible member 34 having first and second end portions 36 and 38. The first end portion 36 of the member 34 is secured to the rear surface 20 of the drawer front structure 16 by a connector such as contact cement, VELCRO™, double-sided adhesive tape or the like which is schematically shown at reference number 42. If desired, a suitable fastener, such as a screw, nail or staple, may be used to attach the pull 12 to the inside of the drawer.

The flexible member 34 has an intermediate portion 39 extending between the first and second end portions 36 and 38. The intermediate portion 39 extends over the peripheral edge surface 22 of the drawer front structure 16. The flexible intermediate portion 39 is shaped by engagement with the upper part of the front structure 16 of the drawer 14. This results in the second end portion 38 of the flexible member 34 being disposed in engagement with the front surface 18 of the drawer 14.

The flexible member 34 has a manually gripable rigid part 40 at the second end portion 38. The rigid part 40 lies against, without being secured to, the front surface 18 of the drawer front structure 16. The manually gripable rigid part 40 is pulled outward away from the front surface 18 to open the drawer 14.

The flexible elongate member 34 of the pull includes a pocket 44 (FIG. 2) for containing a rigid article 46 such as a brass or copper ring, a piece of solid wood or plastic or other material. The rigid article 46 is approximately the size of a United States silver dollar coin, or approximately 1.5 inches in diameter. The rigid article 46 functions as a weight to tension the flexible member 34 and to position the second end portion 38 of the flexible member in engagement with the front surface 18 of the drawer 14.

The pocket 44 is formed by folding a length, which is less than the total length, of the flexible elongate member 34 over itself so that there is an overlapping region. The sides of an overlapping region of the member 34 are sewn together with suitable thread to form the pocket 44 for containing the rigid article 46. The open end of the pocket may be sewn shut after the rigid article 46 is placed into the pocket. Since the rigid article 46 is enclosed by the flexible member 34, the rigid article can not mar the finish on the front surface 18 of the drawer 14.

The pull 12 does not include any parts, such as screws, which penetrate the front surface 18 of the drawer 14. The manually gripped rigid part 40, when pulled to open the drawer 14, is spaced apart from the front surface 18 of the drawer front structure 16 and tensions the intermediate portion 39.

The flexible elongate member 34 can be made of a textile material such as velvet, velveteen, silk, satin, flannel, fleece, brocade, imitation leather, imitation suede, cotton fabric, polyester fabric and cotton/polyester blend fabric. Alternatively, the flexible elongate member 34 can be made of a strip of leather. The material of the flexible member 34 does not mar the front surface 18 on the drawer front structure 16 by resting against the front surface.

The rigid article 46 is encased by the textile material. The manually gripable rigid part 40 also includes a decorative element 48 attached to the textile material encasing the rigid article 46. The decorative element 48 can be a button, imitation jewelry, imitation wood or a wood carving. The decorative element 48 is advantageously positioned so that it can not engage the front surface 18 of the drawer 14. Therefore, the front surface 18 of the drawer 14 is engaged by only the relatively soft material of the member 34.

In the illustrated embodiments, the pull 12 includes a flexible elongate member 34 which is made of a strip of leather. The manually gripable rigid part 40 includes a brass ring 46 encased by the strip of leather in the pocket 44. A decorative button 48 is attached to the strip of leather encasing the brass ring. The decorative button 48 is visible when viewing the front face of the drawer 14. If desired, the decorative button 48 may be omitted.

If it is desired to conceal the pull 12, the pull can be entirely positioned in the drawer 14. This is accomplished by moving the end portion 38 of the pull 12 upward from the position shown in FIG. 2 and across the upper portion of the front structure 16. The end portion 38 of the pull 12 is then dropped into the container portion 24 of the drawer 14. When it is desired to have the pull 12 exposed, the end portion 38 of the pull is merely moved back to the position shown in FIG. 2.

The dimensions of the pull 12 according to FIGS. 1 and 2 are approximately 1–1.5 inches in width, 5 inches in length, and 0.5 inches thick. Of the 5 inches in length of the pull 12, the pocket 44 is approximately 2.2 inches in length. It should be understood that the preceding measurements are given for illustration purposes only and can vary from these size dimensions.

For example, an alternative embodiment of the pull (not shown) can have a length of approximately 8.75 inches. The alternative embodiment of the pull can include a pocket which has a length equal to the total length of 8.75 inches of the pull. It is contemplated that pulls constructed in accordance with the present invention may have many different dimensions. In this alternative embodiment, the pull has a rigid article inside a pocket in the flexible member. The rigid article is a heavy solid elongated piece of steel with a hook shape on one terminal end instead of the brass ring or similar article. The portion of the flexible member enclosing the manually gripable rigid part lies against, without being secured to, the front surface of the drawer front structure in a manner similar to what is shown in FIG. 2. The manually gripable rigid part is pulled away from the front surface of the drawer to open the drawer.

The pull 12 provides a manually gripable surface 40 for a person to grip to pull open a drawer. However, the pull 12 does not attach to the drawer by penetrating or marring the front surface 18 of the expensive wood from which the drawer is manufactured.

Figure 3:
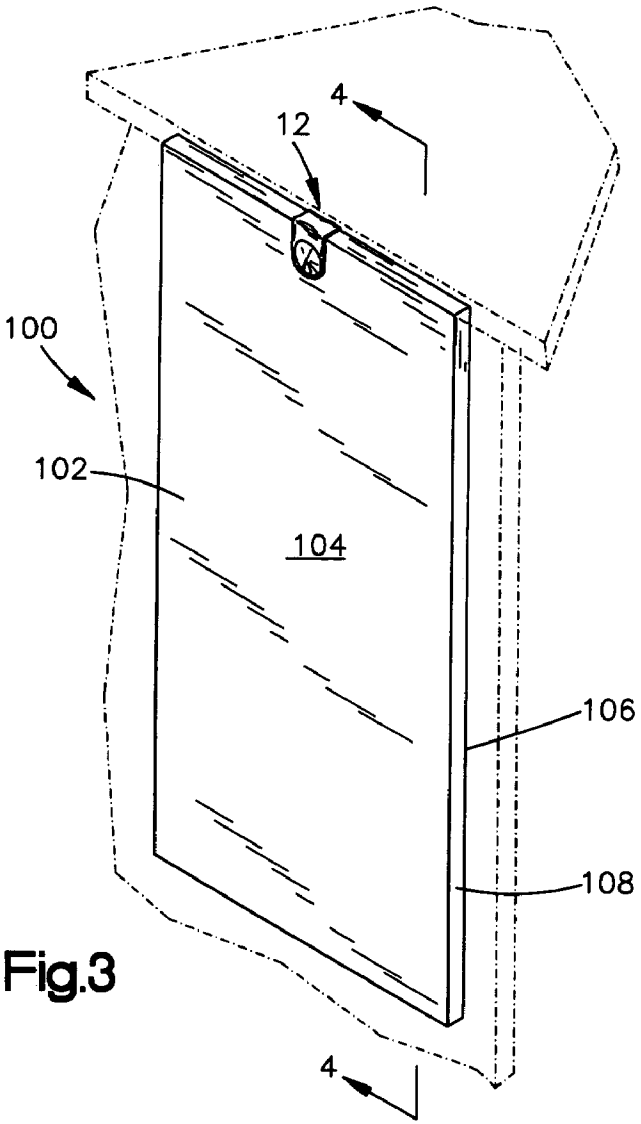
FIG. 3. is a schematic perspective view of a cabinet door with a pull constructed in accordance with the present invention.

FIG. 3 illustrates a partial perspective view of a piece of furniture (dashed lines) with a cabinet door 100. The piece of furniture may be for example, an entertainment center or a china cabinet. The cabinet door 100 is made from any suitable material including an expensive type of wood.

Figure 4:
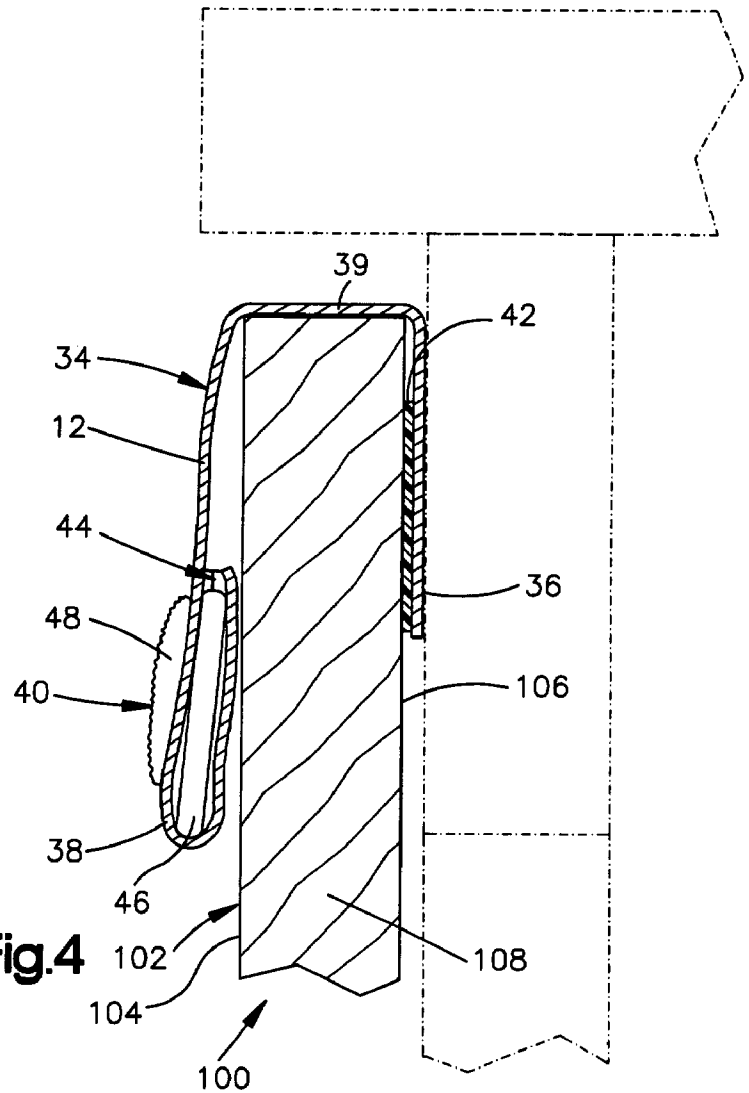
FIG. 4 is a sectional view taken along line 4—4 in FIG. 3.

As best illustrated in FIGS. 3 and 4, the cabinet door 100 has a door front structure 102. The door front structure 102 has a front surface 104 and a rear surface 106 facing in a direction opposite the front surface 104. The front surface 104 is spaced apart from the rear surface 106 by a peripheral edge surface 108 extending between and connecting the front surface 104 and the rear surface 106. The cabinet door 100 closes an opening (not shown) in the furniture. The pull 12 is attached to the cabinet door 100 and is for pulling open the cabinet door 100 to open the opening in the furniture.

The first end portion 36 of the elongate flexible member 34 of the pull 12 is secured to the rear surface 106 of the door front structure 102 by a connector 42 such as used for securing the pull 12 to the drawer 14.

The intermediate portion 39 of the pull 12 extends over the peripheral edge surface 108 of the cabinet door 100. The flexible intermediate portion 39 is shaped by engagement with the upper part of the door front structure 102. This results in the second end portion 38 of the flexible member 34 being disposed in engagement with the door front surface 102.

The manually gripable rigid part 40 of the pull 12 lies against, without being secured to, the door front surface 102. The rigid part 40 is pulled outward away from the door front surface 102 to open the cabinet door 100. The manually gripable rigid part 40, when pulled to open the cabinet door 100, is spaced apart from the door front surface 102 and tensions the flexible intermediate portion 39. The pull 12 does not penetrate or mar the door front surface 102 of the cabinet door 100.

From the above description of the invention, those skilled in the art will perceive improvements, changes and modifications. For example, the pull can be used with furniture constructed from other less expensive wood or other materials, instead of furniture constructed from expensive wood. Such improvements, changes and modifications within the skill of the art are intended to be covered by the appended claims.

Having described the invention, the following is claimed:

1. A drawer assembly comprising:

a drawer including a drawer front structure having a front surface and a rear surface with an upper peripheral surface extending between said front surface and said rear surface; and a drawer pull for pulling open said drawer, said drawer pull comprising an elongate flexible member having first and second end portions with an intermediate portion disposed between said first and second end portions, said first end portion of said flexible member being secured to said rear surface of said drawer front structure, said intermediate portion of said flexible member extends over said upper peripheral surface of said drawer front structure, said second end portion of said flexible member having a manually gripable rigid part which lies against said front surface of said drawer front structure without being secured to said front surface of said drawer front structure, said manually gripable rigid part of said flexible member being pulled to open said drawer.

2. A pull for pulling open a movable member made of wood which closes an opening, said pull comprising:

an elongate flexible member having first and second end portions, said first end portion being connectable to an inner wood surface of a front portion of the movable member, said flexible member having an intermediate portion disposed between said first and second end portions and extendable over an edge portion of the movable member, said flexible member having a manually gripable rigid part which is engagable with an outer front surface of the movable member, said manually gripable rigid part being spaced from the movable member and said intermediate portion being tensioned when pulling open the movable member to open said opening, wherein said manually gripable rigid part, when pulled to open said drawer, is spaced from said front surface of said drawer front structure.

3. A pull for pulling open a movable member made of wood which closes an opening, said pull comprising:

an elongate flexible member having first and second end portions, said first end portion being connectable to an inner wood surface of a front portion of the movable member, said flexible member having an intermediate portion disposed between said first and second end portions and extendable over an edge portion of the movable member, said flexible member having a manually gripable rigid part which is engagable with an outer front surface of the movable member, said manually gripable rigid part being spaced from the movable member and said intermediate portion being tensioned when pulling open the movable member to open said opening, wherein said flexible member includes a textile material and said manually gripable rigid part includes a rigid article encased by said textile material.

4. The drawer assembly of claim 3 wherein said textile material is selected from the group consisting of: velvet, velveteen, silk, satin, flannel, fleece, brocade, imitation leather, imitation suede, cotton fabric, polyester fabric and cotton/polyester blend fabric.

5. A pull for pulling open a movable member made of wood which closes an opening, said pull comprising:

an elongate flexible member having first and second end portions, said first end portion being connectable to an inner wood surface of a front portion of the movable member, said flexible member having an intermediate portion disposed between said first and second end portions and extendable over an edge portion of the movable member, said flexible member having a manually gripable rigid part which is engagable with an outer front surface of the movable member, said manually gripable rigid part being spaced from the movable member and said intermediate portion being tensioned when pulling open the movable member to open said opening, wherein said flexible member includes a strip of leather.

6. A pull for pulling open a movable member made of wood which closes an opening, said pull comprising:

an elongate flexible member having first and second end portions, said first end portion being connectable to an inner wood surface of a front portion of the movable member, said flexible member having an intermediate portion disposed between said first and second end portions and extendable over an edge portion of the movable member, said flexible member having a manually gripable rigid part which is engagable with an outer front surface of the movable member, said manually gripable rigid part being spaced from the movable member and said intermediate portion being tensioned when pulling open the movable member to open said opening, further including a decorative element connected to said flexible member, said decorative element being selected from the group consisting of: a button, imitation jewelry, imitation wood and a wood carving.

7. A pull for pulling open a movable member made of wood which closes an opening, said pull comprising:

an elongate flexible member having first and second end portions, said first end portion being connectable to an inner wood surface of a front portion of the movable member, said flexible member having an intermediate portion disposed between said first and second end portions and extendable over an edge portion of the movable member, said flexible member having a manually gripable rigid part which is engagable with an outer front surface of the movable member, said manually gripable rigid part being spaced from the movable member and said intermediate portion being tensioned when pulling open the movable member to open said opening, wherein said rigid part is selected from the group consisting of: wood, metal and plastic.

8. A pull for pulling open a movable member made of wood which closes an opening, said pull comprising:

an elongate flexible member having first and second end portions, said first end portion being connectable to an inner wood surface of a front portion of the movable member, said flexible member having an intermediate portion disposed between said first and second end portions and extendable over an edge portion of the movable member, said flexible member having a manually gripable rigid part which is engagable with an outer front surface of the movable member, said manually gripable rigid part being spaced from the movable member and said intermediate portion being tensioned when pulling open the movable member to open said opening, wherein said flexible member includes a strip of leather and said manually gripable rigid part includes a rigid article encased by said strip of leather and a decorative element attached to said strip of leather.

* * * * *